US010065837B2

(12) United States Patent
Park

(10) Patent No.: US 10,065,837 B2
(45) Date of Patent: Sep. 4, 2018

(54) PASSENGER CONVEYOR

(71) Applicant: Otis Elevator Company, Farmington, CT (US)

(72) Inventor: Chan-Jong Park, Vienna (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/590,358

(22) Filed: May 9, 2017

(65) Prior Publication Data

US 2017/0327349 A1 Nov. 16, 2017

(30) Foreign Application Priority Data

May 10, 2016 (EP) ..... 16168966

(51) Int. Cl.

| | |
|---|---|
| ***B66B 23/02*** | (2006.01) |
| ***B66B 21/04*** | (2006.01) |
| ***B66B 23/12*** | (2006.01) |
| ***B66B 23/24*** | (2006.01) |

(52) U.S. Cl.

CPC ..... *B66B 23/026* (2013.01); *B66B 21/04* (2013.01); *B66B 23/022* (2013.01); *B66B 23/024* (2013.01); *B66B 23/12* (2013.01); *B66B 23/24* (2013.01)

(58) Field of Classification Search

CPC ..... B66B 23/022; B66B 23/026

See application file for complete search history.

(56) References Cited

U.S. PATENT DOCUMENTS

| | | | | |
|---|---|---|---|---|
| 5,282,529 | A | 2/1994 | Schwammle | |
| 5,348,131 | A * | 9/1994 | Yamaguchi | B66B 23/02 198/321 |
| 5,980,406 | A | 11/1999 | Mott et al. | |
| 6,527,099 | B2 | 3/2003 | Ostermeier et al. | |
| 6,637,579 | B2 * | 10/2003 | Pietz | B66B 23/022 198/322 |
| 7,063,202 | B2 * | 6/2006 | Ossendorf | B66B 21/10 198/321 |
| 7,077,257 | B2 | 7/2006 | Pietz | |

(Continued)

FOREIGN PATENT DOCUMENTS

| | | | | |
|---|---|---|---|---|
| EP | 1304302 | B1 | 12/2004 | |
| GB | 2243430 | A * | 10/1991 | B66B 23/022 |

(Continued)

OTHER PUBLICATIONS

Extended EP Search Report for application EP 16168966.6, dated Nov. 18, 2016, 6pgs.

*Primary Examiner* — Thomas Randazzo

(74) *Attorney, Agent, or Firm* — Cantor Colburn LLP

(57) ABSTRACT

A passenger conveyor (10) comprises a plurality of treads (16) interconnected to form an endless tread band (17), the passenger conveyor (10) comprising a chain and sprocket drive system including at least two drive sprockets (24*a*, 24*b*), each drive sprocket (24*a*, 24*b*) drivingly coupled to a respective drive chain (20*a*, 20*b*), each drive sprocket (24*a*, 24*b*) having a predetermined number of drive sprocket teeth (38*a*, 38*b*) positioned at a predetermined drive sprocket teeth pitch (αa, αb) with respect to each other, wherein the drive sprockets (24*a*, 24*b*) are configured to rotate with the same angular velocity, but at a predetermined phase difference (β) with respect to each other.

15 Claims, 6 Drawing Sheets

(56) References Cited

U.S. PATENT DOCUMENTS

| | | | |
|---|---|---|---|
| 7,147,099 | B2 | 12/2006 | Guernsey et al. |
| 7,195,115 | B2 | 3/2007 | Depaso |
| 7,296,671 | B2 | 11/2007 | Pietz |
| 7,442,139 | B2 | 10/2008 | Kubo et al. |
| 8,292,059 | B2 | 10/2012 | Grobbel |
| 9,394,143 | B2 * | 7/2016 | Makovec ..... B66B 23/022 |
| 2014/0066240 | A1 | 3/2014 | Srb-Gaffron et al. |
| 2016/0039641 | A1 | 2/2016 | Srb-Gaffron et al. |

FOREIGN PATENT DOCUMENTS

| | | | |
|---|---|---|---|
| GB | 2243430 | A | 10/1991 |
| SU | 605759 | A1 | 5/1978 |
| WO | 2013052032 | A1 | 4/2013 |

* cited by examiner

PASSENGER CONVEYOR

The present disclosure generally relates to passenger conveyors having a chain and sprocket drive system. More particularly, the present disclosure relates to reducing vibration and noise associated with chain and sprocket drive systems in such passenger conveyors.

Several types of passenger conveyors, such as escalators, moving walkways, moving sidewalks, etc. are widely used these days to effectively transport passengers from one location to another. Areas of usage of these passenger conveyors often include airports, hotels, shopping malls, museums, railway stations and other public buildings. Such passenger conveyors typically have two landings (e.g., a top landing and a bottom landing in case of an escalator) and a plurality of steps or pallets traveling in a closed loop in between the landings.

Within the scope of this disclosure, the term "tread" is used to refer to steps or elements of steps, as they are used in escalators, as well as to pallets, as they are used in moving walkways.

In a passenger conveyor as referred to herein a plurality of treads are connected to each other to form an endless tread band which is moveable in a conveying direction. The endless tread band forms a closed loop including a load track and a return track interconnected by first and second turnaround sections located at the landings. The treads are drivingly coupled to a pair of tread chains provided on both lateral sides of the treads. Typically, each of the tread chains is driven by a tread chain sprocket. The tread chain sprockets are driven by a common drive shaft which is driven by a main drive motor.

Passenger conveyors also include moving handrails traveling together with the treads, and a truss structure supporting the treads and moving handrails. The moving handrails are driven by a handrail drive synchronized with the tread band. Usually, also the moving handrails are driven by a chain and sprocket drive system.

The interaction of the tread chain with the tread chain sprocket produces fluctuations and vibrations. A tread chain, like any other drive chain, is made up by a plurality of discrete chain links, referred to herein as tread chain links, connected to each other by way of connecting elements, such as chain pins, chain bushings or chain rollers, to form a closed loop. The discrete chain links often have a pairwise configuration with pairs of inner chain link plates and pairs of outer chain link plates pivotably connected to each other by respective connecting elements. A drive sprocket, e.g. the tread chain sprocket, includes a profiled wheel having a plurality of engaging teeth for meshing and engaging the connecting elements and/or the chain links, in order to move the tread chain as the tread chain sprocket rotates. The engagement of the connecting elements and/or chain links of the tread chain with the engaging teeth of the tread chain sprocket causes the tread chain to vibrate and fluctuate. These vibrations and fluctuations are often called "polygonal effect" or "chordal action" and affect the ride experience of a user who typically feels these vibrations and fluctuations when travelling along the load track of the passenger conveyor. Noise generated by the vibrations resulting from the engagement of the tread chain with the tread chain sprocket is another concern.

Therefore, mitigating or compensating the polygonal effect is desirable. Generally, the less tread chain links engage sprocket teeth at a given time, the stronger the polygonal effect is. Therefore, the polygonal effect may be mitigated by reducing the pitch of the tread chain links and/or by increasing the diameter of the tread chain sprocket. Reducing the pitch of the tread chain links involves increasing the number of tread chain links and other associated parts, such as chain rollers, chain pins, chain bushings, chain link plates, etc. Thereby, the overall cost of the associated system increases. Furthermore, the effort involved with the necessary maintenance of the increased number of components increases, and so does the amount of lubricant needed to reduce the increased wear and tear amongst those components. This increased wear and tear can additionally reduce the service life time of the tread chain and the tread chain sprocket. Increasing the diameter of the tread chain sprocket(s) to increase the number of sprocket teeth in engagement with the tread chain links is often undesirable because of restricted space available in the turnaround sections.

Similar considerations apply with respect to other chain and sprocket drive systems in passenger conveyors, e.g. chain and sprocket drive systems for driving moving handrails or a main drive chain and sprocket system.

Accordingly, it would be beneficial to provide an alternative to mitigate noise and vibration caused by the polygonal effect in a passenger conveyor, particularly when using a chain and sprocket drive system having a large chain pitch and small number of sprocket teeth.

A passenger conveyor according to an exemplary embodiment of the invention includes a plurality of treads interconnected to form an endless tread band, the passenger conveyor comprising a chain and sprocket drive system including at least two drive sprockets, each drive sprocket drivingly coupled to a respective drive chain, each drive sprocket having a predetermined number of drive sprocket teeth positioned at a predetermined drive sprocket teeth pitch with respect to each other, wherein the drive sprockets are configured to rotate with the same angular velocity, but at a predetermined phase difference with respect to each other.

Exemplary embodiments of the invention will be described in the following with respect to the enclosed figures.

Figure 1:
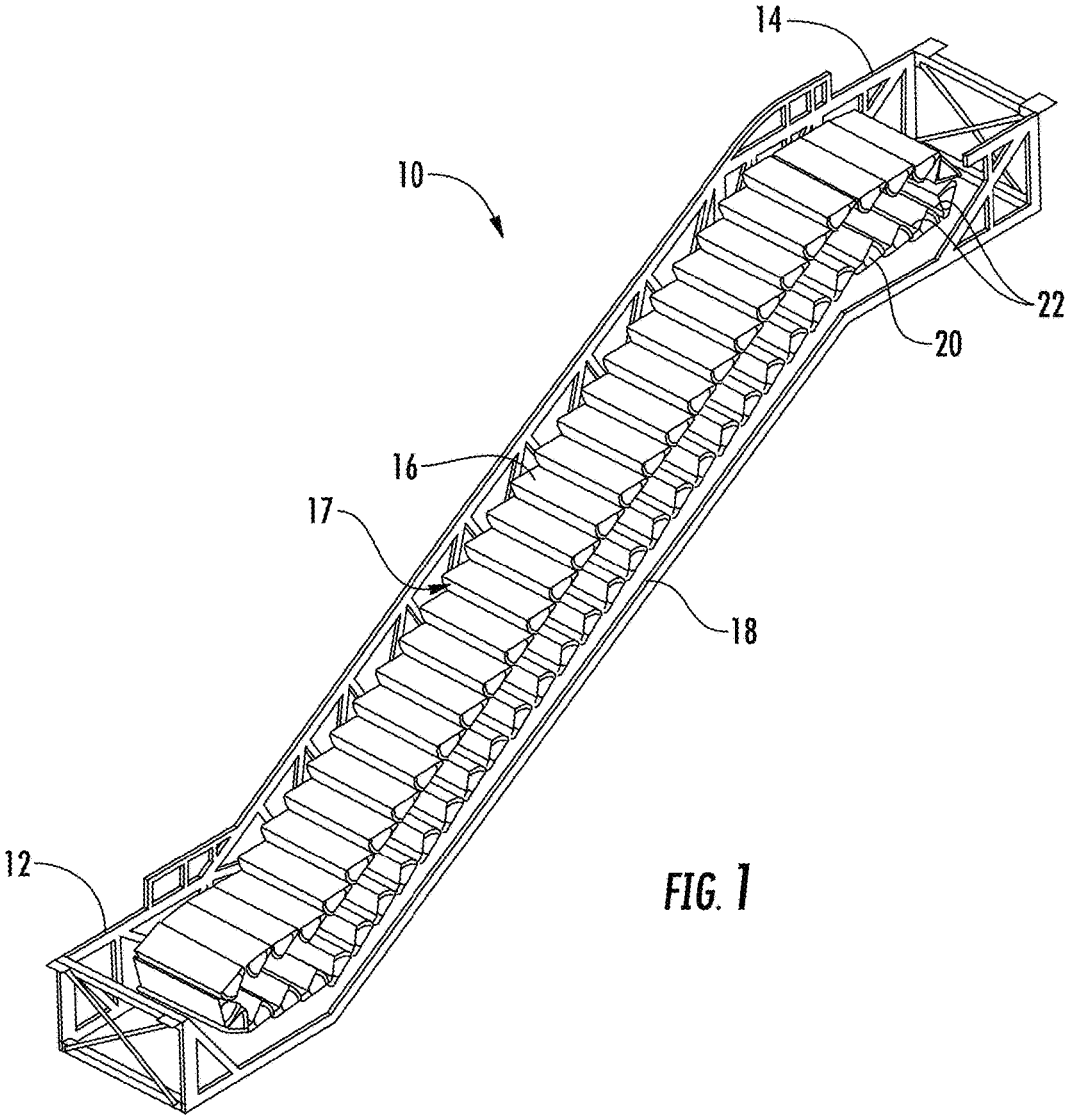
FIG. 1 shows an example of a passenger conveyor having the configuration of an escalator.

An example of a passenger conveyor 10 according to exemplary embodiments of the present invention is shown in FIG. 1. The passenger conveyor 10 in FIG. 1 has the configuration of an escalator and includes a lower landing 12, an upper landing 14, a plurality of treads 16 forming an endless tread band 17, and a truss 18. The endless tread band 17 connects the lower landing 12 and the upper landing 14 thereby transporting passengers between the lower landing 12 and the upper landing 14. A tread chain 20 having a plurality of tread chain links 22 (only two tread chain links are designated by 22 in FIG. 1) is engaged with the plurality of treads 16 in order to drive and guide the treads 16 in an endless loop between the upper landing 14 and the lower landing 12. The tread chain 20 is driven by rotation of a tread chain drive sprocket 24, which is not visible in FIG. 1, but shown in FIG. 2.

The passenger conveyor 10 shown in the Figures has the configuration of an escalator. For an escalator, the term step is often used to refer to the tread and the terms step band and step chain are often used as examples of a tread band and a tread chain, respectively.

Figure 2:
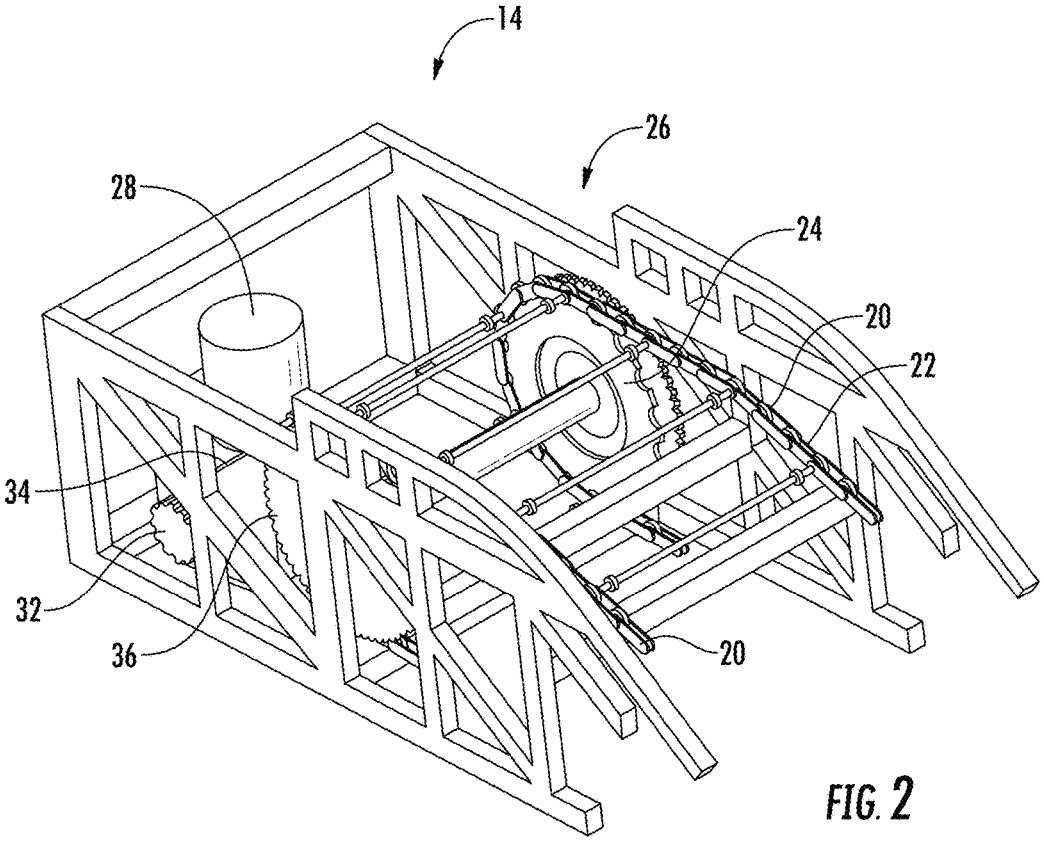
FIG. 2 shows an example of a drive module located at the upper landing of the passenger conveyor shown in FIG. 1.

FIG. 2 shows the upper landing 14 of the escalator 10 shown in FIG. 1. A drive module 26 is provided in a pit beneath the upper landing 14. The drive module 26 includes a motor 28, which may directly or indirectly drive a main drive shaft provided with a machine drive chain sprocket 32. The machine drive chain sprocket 32 in turn drives a main drive chain 34 which engages a main drive chain sprocket 36. The main drive chain sprocket 36 engages with, and rotates concurrently with, a pair of tread chain drive sprockets 24 (only one tread chain drive sprocket 24 is visible in FIG. 2 on the right side; the other tread chain drive sprocket is provided on the left side hidden behind the main drive sprocket 36). Each of the tread chain drive sprockets 24 is configured to engage a respective tread chain 20. In other embodiments, the tread chain drive sprockets 24 may be driven by the main drive shaft via a belt, cogged belt or via a gear train.

Notwithstanding the components of the passenger conveyor 10 described above, it will be understood that several other components, such as gearbox, brakes, etc., that are commonly employed in passenger conveyor systems are contemplated and considered within the scope of the present disclosure. It will also be understood that while several of the components, such as the machine drive chain sprocket 32 and the main drive chain sprocket 36 described above are driven by chains, in at least some embodiments, one or more of those components may be driven by belts or other commonly employed mechanisms. Furthermore, in at least some embodiments, the main drive shaft may directly drive the main drive chain sprocket 36, without the usage of the machine drive chain sprocket 32 and the main drive chain 34. In yet other embodiments, the main drive shaft may directly drive (by belts, chains or gears) the tread chain drive sprockets 24 without the usage of the machine drive chain sprocket 32 or the main drive chain sprocket 36.

Figure 3:
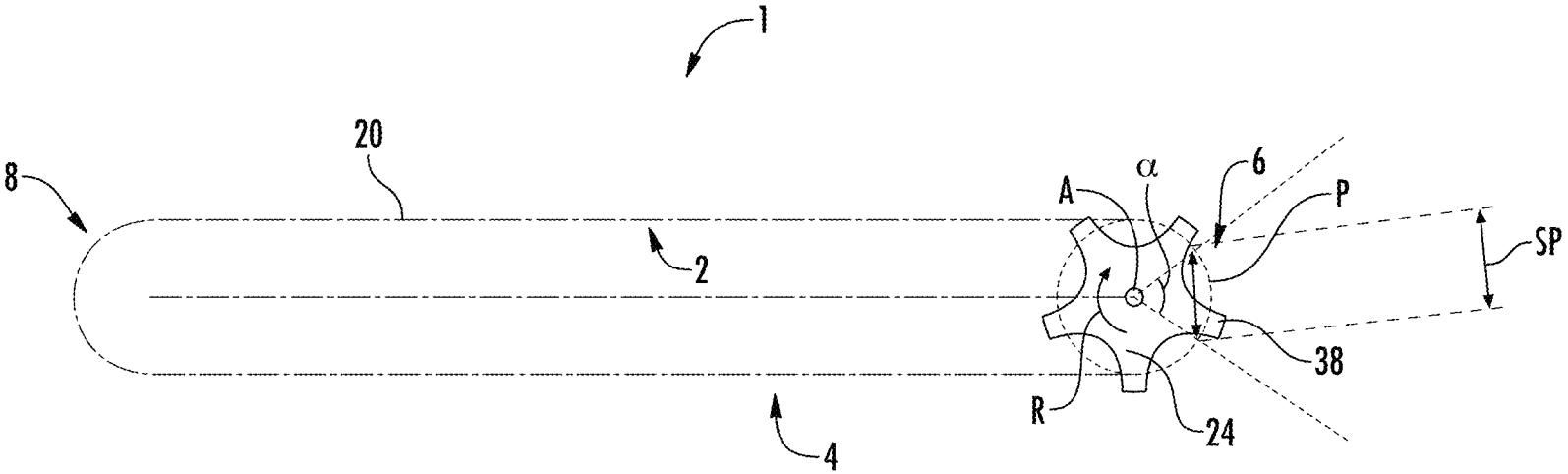
FIG. 3 shows a schematic view of a chain drive, as may be used for driving a passenger conveyor as it is shown in FIGS. 1 and 2.

FIG. 3 shows a schematic view of a chain and sprocket drive 1. The chain and sprocket drive 1 may be used in a passenger conveyor 10 as it is shown in FIG. 1, for example for driving the tread band 17 around its endless path. In such embodiment, the drive chains of the chain and sprocket drive 1 are tread chains drivingly coupled to the tread band 17, respectively. In further embodiments the chain and sprocket drive 1 may be a main drive system including the machine drive chain sprocket 32, main drive chain 34 and main drive chain sprocket 36, as shown in FIG. 2. Although not explicitly shown in the Figures, in further embodiments, the chain and sprocket drive system 1 may be configured for driving a moving handrail of the passenger conveyor 10. The configuration of such chain and sprocket drive system will be similar and the embodiments for reducing noise and vibration in a passenger conveyor caused by such chain and sprocket drive system disclosed herein may be applied to any of these chain and sprocket drive systems.

In the following the chain and sprocket drive system 1 used to drive the tread band 17 will be described as an exemplary embodiment, and the reference signs used in FIG. 3 refer to such tread band drive system. It is to be understood that the same description may be applied with respect to other chain and sprocket drive systems as used in a passenger conveyor, particularly with respect to the main drive system including the machine drive chain sprocket 32, main drive chain 34 and main drive chain sprocket 36, and with respect to the chain and sprocket drive system for driving a moving handrail.

Figure 4:
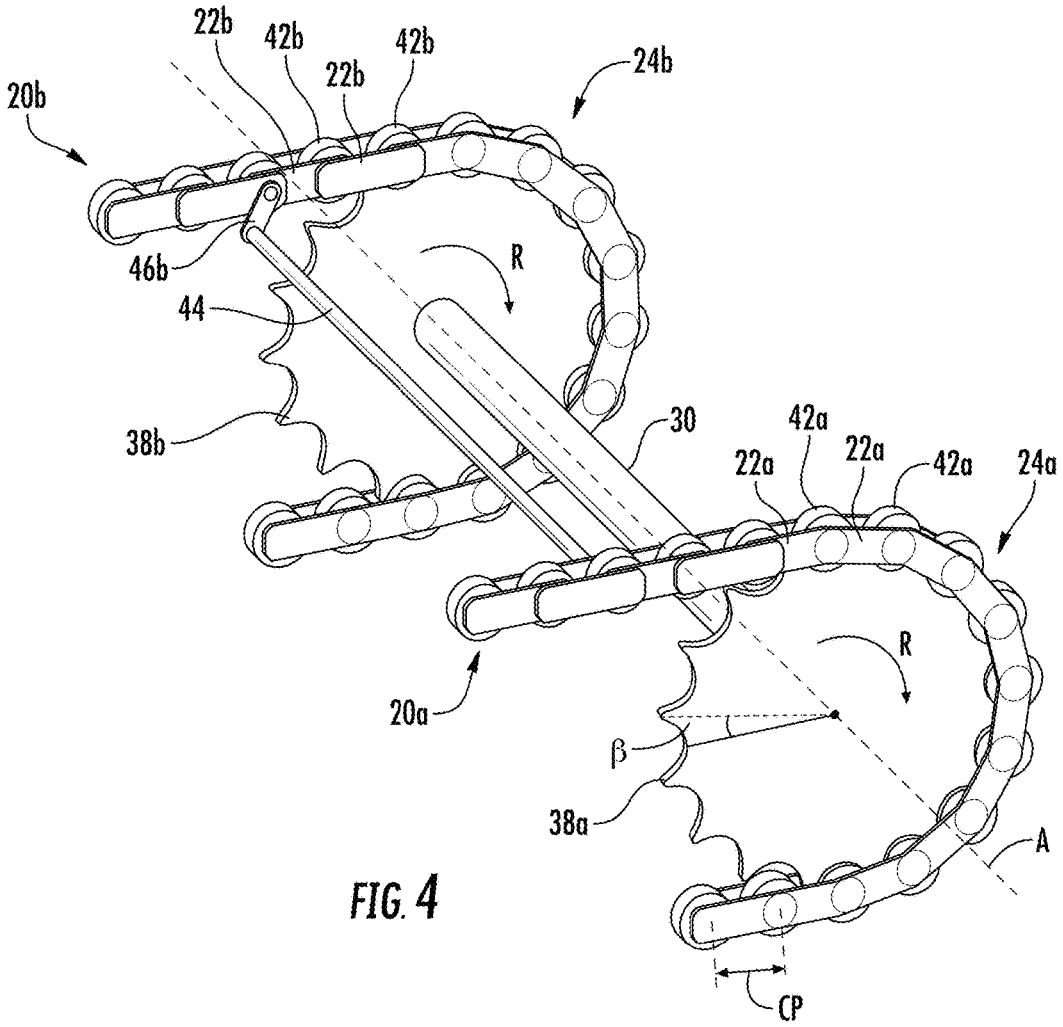
FIG. 4 shows a perspective view of a tread chain drive system according to an embodiment.

The chain drive comprises a drive chain, e.g. the tread chain 20 shown in FIG. 1. The tread chain 20 is configured to travel along a closed loop forming a load track 2 and a return track 4 interconnected by first and second turnaround sections 6, 8, respectively. The turnaround sections 6, 8 are located at opposing ends of the closed loop. A drive sprocket, e.g. the tread chain drive sprocket 24, which is configured for driving the tread chain 20, is arranged in the first turnaround section 6 shown on the right side of FIG. 3. The tread chain drive sprocket 24 rotates around a tread chain drive sprocket axis A and has a plurality of tread chain drive sprocket teeth 38 provided around a periphery of the tread chain drive sprocket 24 at a predetermined tread chain drive sprocket pitch. The tread chain drive sprocket pitch may be expressed as a tread chain drive sprocket pitch angle $\alpha$ or as a tread chain drive sprocket pitch distance SP between adjacent teeth along a pitch circle P of the tread chain drive sprocket 24 (see FIG. 3, the pitch circle P is indicated by a dashed circle in FIG. 3). The tread chain drive sprocket pitch distance SP corresponds to the distance between points of engagement of the tread chain rollers with two adjacent tread chain drive sprocket teeth 38 when the respective tread chain links 22 are engaged with the tread chain drive sprocket 24. Therefore, the tread chain drive sprocket pitch distance SP corresponds to the pitch CP of the tread chain 20, as indicated in FIG. 4. It is to be understood that the tread chain drive sprocket pitch angle $\alpha$ and the tread chain drive sprocket pitch distance SP may be measured with respect to any reference point on the tread chain drive sprocket teeth 38 (e.g. with respect to the peaks of those teeth 38, or with respect to a midpoint between two adjacent teeth 38).

In the embodiment shown in FIG. 3, the tread chain drive sprocket 24 will turn clockwise in normal operation, as indicated by arrow R. In consequence, in normal operation the tread chain 20 will travel from left to right in the upper load track 2 and from right to left in the lower return track 4.

In the embodiment shown engagement of the tread chain 20 with the tread chain drive sprocket 24 takes place on the top of the tread chain drive sprocket 24 in normal operation of the escalator 10. In reverse operation of the escalator 10 the tread chain drive sprocket 24 rotates in the opposite direction and engagement of the tread chain 20 with the tread chain drive sprocket 24 takes place at the lowest point of the tread chain drive sprocket 24. A guiding rail may guide the tread chain 20 towards the top point or bottom point of the tread chain drive sprocket 24 respectively.

When the tread chain drive sprocket 24 is driven with constant angular velocity around the tread chain drive sprocket axis A, an undesirable polygonal effect will occur due to the deflection of the tread chain 20 when engaging with, and disengaging from, the tread chain drive sprocket 24. The polygonal effect is caused by velocity changing zones occurring when the links 22 of the tread chain 20 engage with the tread chain drive sprocket 24, and/or disengage from the tread chain drive sprocket 24, thereby changing between a linear movement path and a curved movement path.

Figure 5:
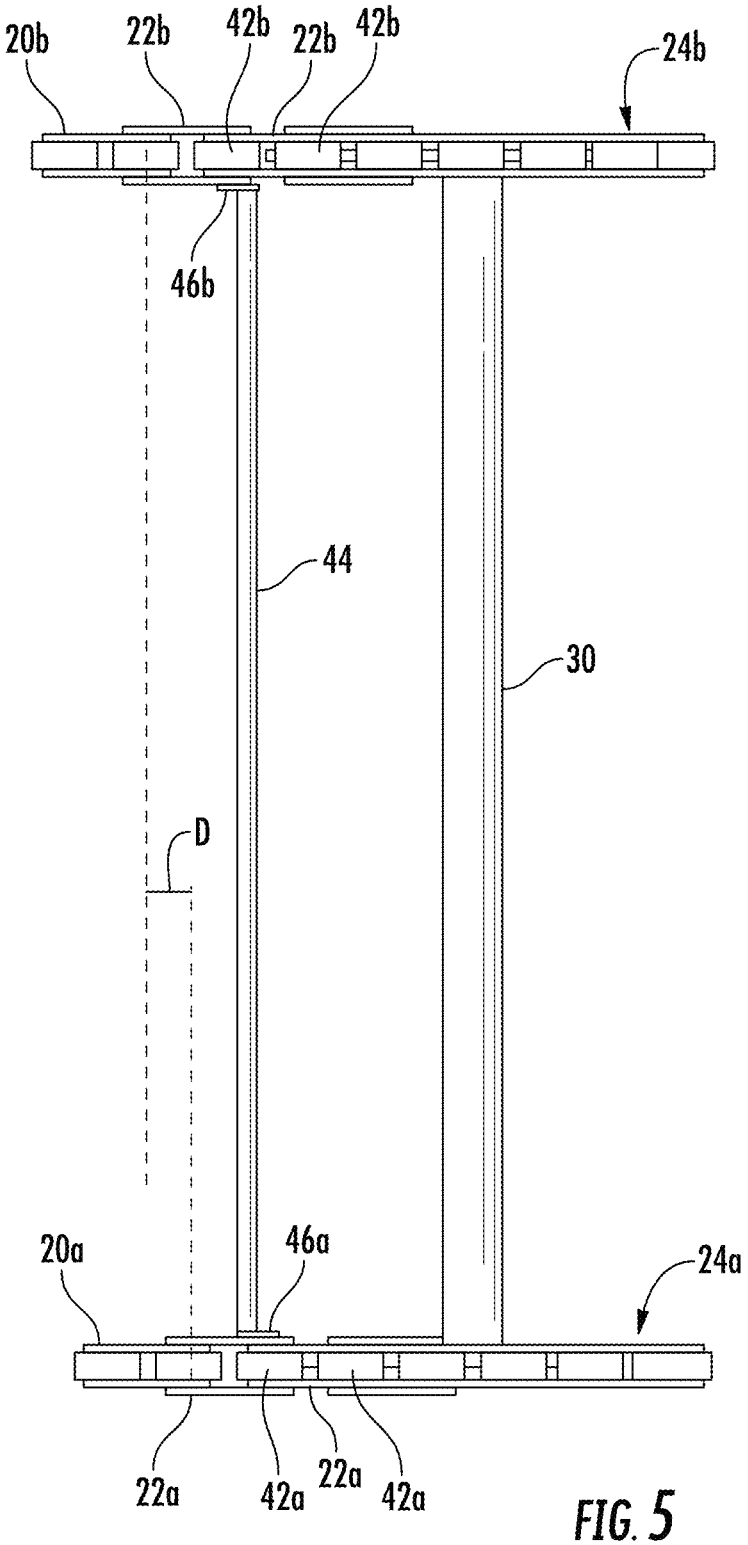
FIG. 5 shows a top view of the tread chain drive system of FIG. 4.
Figure 6:
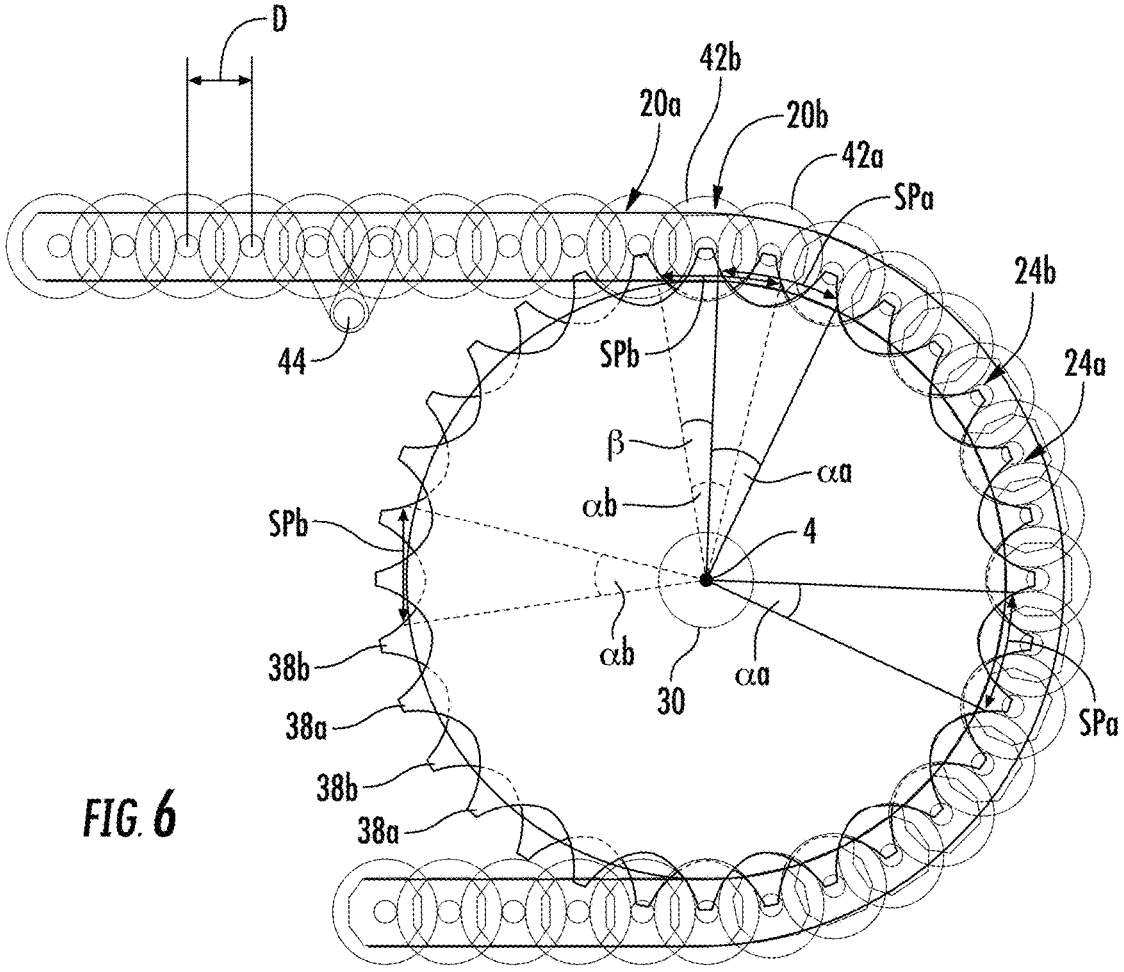
FIG. 6 shows the sprockets of the tread chain drive system of FIGS. 4 and 5 in a side view.

FIG. 4 shows a perspective view of a tread chain drive system. FIG. 5 shows a top view of the tread chain drive system of FIG. 4, and FIG. 6 shows the tread chain sprockets 24*a* and 24*b* of the tread chain drive system of FIGS. 4 and 5 in a side view. The tread chain drive system shown in FIGS. 4 to 6 may be used in an escalator 10, as shown in FIGS. 1 to 2. Alternatively, the tread chain drive system may be used in a moving walkway (in which case it will be referred to as a pallet chain drive system). The tread chain drive system of FIGS. 4 to 6 comprises two chain and sprocket drive systems as shown in FIG. 3. Each of the chain and sprocket drive systems includes a tread chain 20*a*, 20*b* engaging a respective tread chain drive sprocket 24*a*, 24*b*. The tread chain drive sprockets 24*a*, 24*b* are supported on a common drive shaft 30. The drive shaft 30 drives the tread chain drive sprockets 24*a*, 24*b* for concurrent rotation at a same angular velocity around a tread chain drive sprocket axis A, as indicated by R in FIG. 4 (showing the normal operation of the tread chain drive system).

Each of the tread chains 20*a*, 20*b* has the configuration of a roller chain comprising tread chain links 22*a*, 22*b* connected by tread chain rollers 42*a*, 42*b*, respectively. The tread chain links 22*a*, 22*b* have the configuration of pairs of inner tread chain link plates and pairs of outer tread chain link plates. A pair of inner tread chain link plates is connected to a pair of outer tread chain link plates via a respective tread chain pin and tread chain roller 42*a*, 42*b*. For clarity, in FIGS. 4 and 5 only two consecutive tread chain links 22*a* and 22*b*, as well as two consecutive tread chain rollers 42*a* and 42*b*, are designated for each of the two tread chains 20*a*, 20*b*. These tread chain links 22*a*, 22*b* form an outer tread chain link and an inner tread chain link, respectively.

In FIGS. 4 to 6, the treads 16 of the tread chains 20*a*, 20*b* are not shown for reasons of clarity. However, FIGS. 4 to 6 show exemplarily one tread chain axle 44 which connects a respective one of the treads 16 to the two tread chains 20*a* and 20*b*. It is to be understood that a respective tread chain axle 44 is provided for mounting each of the treads 16 to the two tread chains 20*a*, 20*b*. As can be seen in FIGS. 4 and 5, the tread chain axle 44 has a cranked shape with a linear middle portion and two end portions 46*a*, 46*b* extending orthogonally from the middle portion at lateral ends of the tread chain axle 44. The cranked end portions 46*a*, 46*b* extend towards opposite sides with respect to the middle portion in order to allow the tread chain axle 44 to be connected to a respective bolt of the tread chains 20*a*, 20*b* which connects two adjacent tread chain links 22*a*, 22*b* and also supports a respective tread chain roller 42*a*, 42*b*. The tread chain axles 44 are provided with the cranked end portions 46*a* and 46*b*, because the tread chain sprockets 24*a*, 24*b* are supported on the drive shaft 30 in such a way that the tread chain sprockets 24*a*, 24*b* rotate with a phase difference to each other. In FIGS. 4 and 6 this phase difference is indicated by β. As a result of this phase difference, the position of corresponding tread chain bolts and tread chain rollers 42*a*, 42*b* of the two tread chains 20*a*, 20*b* is shifted by a distance D with respect to each other, as indicated in FIGS. 5 and 6.

When engaging the tread chain drive sprocket teeth 38*a*, 38*b* of the tread chain drive sprockets 24*a*, 24*b*, respectively, the tread chain links 22*a*, 22*b* are deflected from their linear movement path in the load section or return section to a curved movement path along the pitch circle of the respective tread chain drive sprocket 24*a*, 24*b*. This deflection causes the polygonal effect discussed above. The polygonal effect results in noise and vibration produced by the tread chains 20*a*, 20*b*, respectively, and transferred to the treads 16 of the tread band 17 via the tread chain axles 44.

The inventors have found out that noise and vibration caused by the tread chains 20*a*, 20*b* due to the polygonal effect can be reduced significantly by misaligning the tread chain drive sprockets 24*a*, 24*b* with respect to each other. As indicated in FIGS. 4 and 6, the two tread chain drive sprockets 24*a*, 24*b* are supported on the drive shaft 30 in such a way that the two tread chain drive sprockets 24*a*, 24*b* rotate at a same angular velocity around the tread chain drive axis A, but have a predetermined phase difference β with respect to each other. In the embodiment shown in FIGS. 4 to 6, the phase difference β is equal to half of the tread chain drive sprocket pitch, e.g. as expressed by the tread chain drive sprocket pitch angle α. This has the effect that in a circumferential direction of the sprockets the teeth 38*a* of the first tread chain drive sprocket 24*a* do not correspond to the teeth 38*b* of the second tread chain drive sprocket 24*b*. Rather, in a circumferential direction of the sprockets the teeth 38*a* of the first tread chain drive sprocket 24*a* are positioned in an interspace in between two adjacent teeth 38*b* of the second tread chain drive sprocket 24*b*. The teeth 38*a* of the first tread chain drive sprocket 24*a* may be positioned anywhere in the interspace in between two adjacent teeth 38*b* of the second tread chain drive sprocket 24*b*. In a particular configuration as shown in FIGS. 4 to 6 the phase difference β is equal to half of the tread chain drive sprocket pitch α, and hence the position of the teeth 38*a* of the first tread chain drive sprocket 24*a* in a circumferential direction corresponds to midpoints between two adjacent teeth 38*b* of the second tread chain drive sprocket 24*b*, as best visible in the side view of FIG. 6. This configuration provides a particularly good reduction in noise and vibration. In FIG. 6, the circumference of the first tread chain drive sprocket 24*a* is shown by a solid line. The circumference of the second tread chain sprocket 24*b* is shown as a solid line in sections where the teeth 38*b* of the second tread chain drive sprocket 24*b* are visible, and shown as dotted lines where sections in between two adjacent teeth 38*b* are hidden by the teeth 38*a* of the first tread chain drive sprocket 24*a*. The tread chain drive sprocket pitch of the first tread chain drive sprocket 24*a* is indicated in FIG. 6 by a first tread chain drive sprocket pitch angle αa or by a first tread chain drive sprocket pitch distance SPa between adjacent teeth at a pitch circle of the first tread chain drive sprocket 24*a* (see also FIG. 3). In the same way, the tread chain drive sprocket pitch of the second tread chain drive sprocket 24*b* is indicated in FIG. 6 by a second tread chain drive sprocket pitch angle αb or by a second tread chain drive sprocket pitch distance SPb between adjacent teeth at a pitch circle of the second tread chain drive sprocket 24*b* (see also FIG. 3).

As a consequence of the misalignment between the first and second tread chain drive sprockets 24*a*, 24*b*, a large, or even maximum, deflection of the tread chain links 22*a* of the first tread chain 20*a* when engaging the first tread chain drive sprocket 24*a* always corresponds to a small, or even minimum, deflection of the tread chain links 22*b* of the second tread chain 20*b* when engaging the second tread chain drive sprocket 24*b*, and vice versa. It has been demonstrated experimentally that this kind of drive configuration effectively reduces noise and vibration induced by the polygonal effect to a level comparable to the noise and vibration that would have been caused when using tread chain drive sprockets having twice the number of teeth than the tread chain drive sprockets 24*a*, 24*b* shown in FIGS. 4 to 6, but arranged to rotate without a phase difference relative to each other. Remarkable reduction in polygonal effect induced noise and vibration was measurable even for any misalignment of the first and second tread chain drive sprocket with respect to each other, for a misalignment in a range between a quarter and three quarters of the tread chain drive sprocket teeth pitch. For example, when misaligning two 18-tooth sprockets 24*a*, 24*b* in a configuration as shown in FIGS. 4 to 6, comparable levels of vibration and noise can be achieved as when using two 36-tooth sprockets without any misalignment. Therefore, cost effective ride quality enhancement and space reduction in the turnaround sections can be realized by using conventional hardware chain drive technology.

Although described in detail above with respect to a tread chain drive system, the configuration suggested herein can be applied for other chain and sprocket drive systems used in a passenger conveyor, such as main drive chain system and handrail drive systems.

Embodiments described above provide a passenger conveyor comprising a plurality of treads interconnected to form an endless tread band. The passenger conveyor comprises a chain and sprocket drive system including at least two drive sprockets. Each drive sprocket is drivingly coupled to a respective drive chain. Each drive sprocket has a predetermined number of drive sprocket teeth positioned at a predetermined drive sprocket teeth pitch with respect to each other. The drive sprockets are configured to rotate with the same angular velocity, but at a predetermined phase difference with respect to each other.

This configuration allows achieving comparatively low levels of vibration and noise as when using two sprockets having twice the amount of sprocket teeth without any misalignment. Therefore, cost efficient ride quality enhancement and space reduction in the turnaround sections can be realized by using conventional hardware chain drive technology.

Particular embodiments of a passenger conveyor may include any of the following features, alone or in combination, with each other, unless otherwise noted:

Particularly, each drive sprocket may have a same predetermined number of drive sprocket teeth positioned at same predetermined drive sprocket teeth pitch. In such configuration, significant noise and vibration reduction can be achieved if the drive sprockets are configured to rotate at a phase difference to each other. Any phase difference may be possible. It has been found, that good reduction of noise and vibration can be achieved if the drive sprockets are configured to rotate at a phase difference corresponding to between a quarter and three quarters of the drive sprocket teeth pitch with respect to each other. An optimum noise and vibration reduction can be achieved if the drive sprockets are configured to rotate at a phase difference corresponding to a half of the drive sprocket teeth pitch with respect to each other.

The drive sprockets may be configured to rotate around a common drive sprocket axis. For example, the drive sprockets may be supported on a common drive sprocket shaft. This allows driving the drive sprockets for concurrent rotation at a same angular velocity using a same drive motor.

Particularly, the chain and sprocket drive system may include a pair of drive sprockets. Further, the drive chains may be located at opposite lateral sides of the endless tread band. In such configurations, vibration and noise induced by the polygonal effect can be suppressed effectively using a misalignment configuration of the drive sprockets as suggested herein.

Particularly, each of the drive chains may have the configuration of a roller chain. Roller chains are widely used in passenger conveyors. Particularly the endless tread band is usually driven by tread band chains having the configuration of a roller chain. In further embodiments, each of the drive chains may be any of a detachable chain, a pintle chain, a silent chain, and a leaf chain.

In particular, the chain and sprocket drive system may be a tread band drive system, i.e. the drive chains may be tread chains drivingly coupled to the tread band, respectively. As any noise or vibrations produced by the tread band drive system will be transferred to the treads suppression of noise and vibration related to the polygonal effect when the tread chain engages with and disengages from the tread chain drive sprockets is particularly important. The treads may be drivingly engaged by the tread chain at any location. Particularly, the tread chain may be drivingly engaged by a respective tread chain at multiple locations. The noise and vibration reduction suggested herein is particularly effective in a configuration where the tread chains are located on opposite lateral sides of the tread band, respectively, and the tread chains are drivingly engaged with the treads at lateral ends thereof.

In further embodiments the tread chains may be coupled to respective treads of the endless tread band by tread chain axles. Particularly, the tread chain axles may have a cranked configuration. Normally tread chain axles have a linear configuration and connect each tread to corresponding tread chain links of the tread chains located at lateral ends of the tread. The cranked configuration of the tread chain axles allows a corresponding configuration which is specifically adapted to the fact that there is a misalignment between corresponding links of the tread chains along their endless travel path. Each tread may be engaged by the tread chains at a single location or at multiple locations along the tread chain axle.

Particularly, each of the treads of the endless tread band may be connected to a corresponding tread chain link of each of the tread chains via a respective tread chain axle.

In further embodiments, the passenger conveyor may include a chain and sprocket drive systems as suggested herein which is configured to drive moving handrails of the passenger conveyor. Moving handrails are usually located on both lateral sides of the tread band and driven by a drive system such as to move in synchronization with the endless tread band. Often a chain and sprocket drive system is used for driving the moving handrails. Such chain and sprocket drive system may be driven by the main drive system which also drives by the tread chains. Alternatively, a separate handrail drive system may be used which is synchronized with the tread band drive system.

In further embodiments, the passenger conveyor may include a chain and sprocket drive systems as suggested herein which is configured as a main drive system drivingly coupling a motor to tread chain drive sprockets.

REFERENCES

1 chain and sprocket drive
2 load track
4 return track
6 first turnaround section
8 second turnaround section
10 passenger conveyor, in particular escalator
12 lower landing
14 upper landing
16 tread
18 truss
20 tread chain
22 tread chain links
24 tread chain drive sprocket
24*a* first tread chain drive sprocket

24*b* second tread chain drive sprocket
26 drive module
28 motor
32 machine drive chain sprocket
34 main drive chain
36 main drive chain sprocket
38 tread chain drive sprocket teeth
38*a* first tread chain drive sprocket teeth
38*b* second tread chain drive sprocket teeth
42 tread chain roller
42*a* first tread chain roller
42*b* second tread chain roller
44 tread chain axle
46*a* first end portion of tread chain axle
46*a* second end portion of tread chain axle
A tread chain drive sprocket axis
P tread chain drive sprocket pitch circle
SP tread chain drive sprocket pitch distance
SPa first tread chain drive sprocket pitch distance
SPb second tread chain drive sprocket pitch distance
α tread chain drive sprocket pitch angle
αa first tread chain drive sprocket pitch angle
αb second tread chain drive sprocket pitch angle
CP tread chain pitch
β phase difference between first and second tread chain drive sprockets
D distance between corresponding tread chain rollers of first and second tread chains

What is claimed is:

1. Passenger conveyor comprising a plurality of treads interconnected to form an endless tread band, the passenger conveyor comprising:

a chain and sprocket drive system including at least two drive sprockets, each drive sprocket drivingly coupled to a respective drive chain, each drive sprocket having a predetermined number of drive sprocket teeth positioned at a predetermined drive sprocket teeth pitch (αa, αb) with respect to each other, wherein the drive sprockets are configured to rotate with the same angular velocity, but at a predetermined phase difference (β) with respect to each other.

2. Passenger conveyor according to claim 1, wherein the at least two drive sprockets are a pair of drive sprockets.

3. Passenger conveyor according to claim 1, wherein the drive chains are located at opposite lateral sides of the endless tread band.

4. Passenger conveyor according to claim 1, wherein each of the drive chains has the configuration of any of a roller chain, a detachable chain, a pintle chain, a silent chain, and a leaf chain.

5. Passenger conveyor according to claim 1, wherein the chain and sprocket drive system is configured to drive moving handrails.

6. Passenger conveyor according to claim 1, wherein the chain and sprocket drive system is configured as a main drive system drivingly coupling a motor to tread chain drive sprockets.

7. Passenger conveyor according to claim 1, wherein the drive sprockets are configured to rotate around a common drive sprocket axis (A).

8. Passenger conveyor according to claim 7, wherein the drive sprockets are supported on a common drive sprocket shaft.

9. Passenger conveyor according to claim 1, wherein each drive sprocket has a same predetermined number of drive sprocket teeth positioned at same predetermined drive sprocket teeth pitch (αa, αb).

10. Passenger conveyor according to claim 9, wherein the drive sprockets are configured to rotate at a phase difference (β) corresponding to between a quarter and three quarters of the drive sprocket teeth pitch (αa, αb) with respect to each other.

11. Passenger conveyor according to claim 10, wherein the drive sprockets are configured to rotate at a phase difference corresponding to a half of the drive sprocket teeth pitch (αa, αb) with respect to each other.

12. Passenger conveyor according to claim 1, wherein the drive chains are tread chains drivingly coupled to the tread band, respectively.

13. Passenger conveyor according to claim 12, wherein the tread chains are located at opposite lateral sides of the endless tread band, respectively.

14. Passenger conveyor according to claim 12, wherein the tread chains are coupled to respective treads of the endless tread band by tread chain axles having a cranked configuration.

15. Passenger conveyor according to claim 14, wherein each of the treads of the endless tread band is connected to a corresponding tread chain link of each of the tread chains via a respective tread chain axle.

* * * * *